US010915056B2

(12) United States Patent
Ishihara et al.

(10) Patent No.: US 10,915,056 B2
(45) Date of Patent: Feb. 9, 2021

(54) DRUM CARTRIDGE AND METHOD FOR MANUFACTURING DRUM CARTRIDGE

(71) Applicant: CANON KABUSHIKI KAISHA, Tokyo (JP)

(72) Inventors: Shotaro Ishihara, Tokyo (JP); Hiroshi Koyama, Tokyo (JP); Atsushi Endo, Kashiwa (JP); Tomonori Kitan, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/841,777

(22) Filed: Apr. 7, 2020

(65) Prior Publication Data

US 2020/0333741 A1 Oct. 22, 2020

(30) Foreign Application Priority Data

Apr. 22, 2019 (JP) ..... 2019-080774

(51) Int. Cl.
*G03G 21/00* (2006.01)
*G03G 15/00* (2006.01)

(52) U.S. Cl.
CPC ..... *G03G 21/0029* (2013.01); *G03G 15/751* (2013.01); *G03G 2215/0855* (2013.01)

(58) Field of Classification Search
None
See application file for complete search history.

(56) References Cited

U.S. PATENT DOCUMENTS

| | | | | |
|---|---|---|---|---|
| 8,634,755 | B2 * | 1/2014 | Ichikawa | B08B 1/00 399/351 |
| 9,897,967 | B2 | 2/2018 | Koyama et al. | |
| 10,571,851 | B2 | 2/2020 | Ishihara | |
| 2018/0335729 | A1 | 11/2018 | Kitan | |

FOREIGN PATENT DOCUMENTS

| | | | |
|---|---|---|---|
| JP | H11-119620 | A | 4/1999 |
| JP | 2003-029586 | A | 1/2003 |
| JP | 2007-225737 | A | 9/2007 |
| JP | 2012-093682 | A | 5/2012 |

* cited by examiner

*Primary Examiner* — Jas A Sanghera
(74) *Attorney, Agent, or Firm* — Venable LLP

(57) ABSTRACT

A drum cartridge includes a blade, a sheet metal member, a support member, and a fastening member. One of the sheet metal member and the support member includes a first center hole which is formed at a center portion, and a fastening member receiving portion formed at a first end side and configured to fasten the fastening member. The other of the sheet metal member and the support member includes a second center hole which is formed at the center portion, and a through hole which is formed at the first end side and through which the fastening member is passed. The first center hole and the second center hole are arranged such that centers thereof are overlapped. The through hole is configured to be larger than the fastening member receiving portion in a swinging direction with the first and second center holes serving as the center of swing.

4 Claims, 18 Drawing Sheets

DRUM CARTRIDGE AND METHOD FOR MANUFACTURING DRUM CARTRIDGE

BACKGROUND OF THE INVENTION

Field of the Invention

The present invention relates to a drum cartridge equipped with a cleaning device suitably adopted in an image forming apparatus applying an electrophotography technique, such as a printer, a copying machine, a facsimile or a multifunction device, and a method for manufacturing a drum cartridge equipped with the cleaning device.

Description of the Related Art

In an image forming apparatus adopting an electrophotographic technique, toner image borne on a photosensitive drum or an intermediate transfer belt, the same applies hereafter, is transferred to a recording material, but toner, so-called residual toner, may remain on the photosensitive drum after the toner image has been transferred. This toner may cause image defects, so a cleaning device is provided in the image forming apparatus to remove residual toner from the photosensitive drum. A blade-type cleaning device is provided, where a cleaning blade (hereinafter simply referred to as blade) formed of an elastic member such as rubber is abutted against the photosensitive drum to mechanically scrape off toner.

In order to remove toner from the photosensitive drum in the case of a blade type cleaning device, it is preferable to abut the blade against the photosensitive drum with uniform blade pressure in a width direction, or rotational axis direction, that intersects a direction of rotation of the photosensitive drum. Hitherto, in order to achieve uniform blade pressure, an apparatus where a spacer having different thickness in the width direction is provided to regulate the position of the blade has been proposed (Japanese Patent Application Laid-Open Publication No. 2007-225737). Another apparatus has been proposed where a support sheet metal that supports a blade is provided swingably with a center portion in a width direction of the support sheet metal set as a center of swing, and pressurizing the support sheet metal toward the photosensitive drum by a spring and the like to maintain the blade at a position where desirable blade pressure is achieved (Japanese Patent Application Laid-Open Publication No. H11-119620).

According to the apparatus disclosed in above-described Japanese Patent Application Laid-Open Publication No. 2007-225737, blade pressure is varied in steps according to the thickness of the spacer, so that there was a need to use a spacer capable of ensuring appropriate blade pressure for each photosensitive drum, which was time-consuming. Furthermore, if a spacer having an appropriate thickness was not prepared, the blade could not be regulated to a position where blade pressure suitable for the photosensitive drum is acquired, so that a desirable cleaning effect could not be achieved. Meanwhile, according to the apparatus disclosed in above-described Japanese Patent Application Laid-Open Publication No. H11-119620, the blade is formed swingably, so that the blade can be regulated in a stepless manner to a position enabling to achieve a blade pressure suitable for the photosensitive drum. However, if the blade is formed swingably, chattering vibration may occur in the blade if uneven frictional force occurs in the direction of rotation of the photosensitive drum, and it may become difficult to achieve a desirable cleaning effect. Further, if uneven frictional force occurs in the width direction of the photosensitive drum, the blade pressure may be biased in the width direction and toner may slip through the blade, so that a desirable cleaning effect could not be achieved.

SUMMARY OF THE INVENTION

According to one aspect of the present invention, a drum cartridge includes an image bearing member configured to bear a toner image, a frame member configured to rotatably support the image bearing member rotatably, a blade configured to abut against the image bearing member and clean the image bearing member, a sheet metal member configured to support the blade, a support member configured to support the sheet metal member and provided swingably on the frame member so that the sheet metal member is swingable in a direction abutting the blade against and separating the blade from the image bearing member, the support member being urged such that the blade is urged toward a direction abutting against the image bearing member, and a fastening member configured to fix the sheet metal member to the support member. One of the sheet metal member and the support member includes a first center hole which is formed at a center portion in a longitudinal direction of the blade, and a fastening member receiving portion formed at a first end side in the longitudinal direction and configured to fasten the fastening member. The other of the sheet metal member and the support member includes a second center hole which is formed at the center portion in the longitudinal direction, and a through hole which is formed at the first end side in the longitudinal direction and through which the fastening member is passed. The first center hole and the second center hole are arranged such that centers thereof are overlapped. The through hole is configured to be larger than the fastening member receiving portion such that the sheet metal member can be fastened to the support member by the fastening member at each of a first position and a second position which are different in a swinging direction in which the sheet metal member is swung with respect to the support member around the first and second center holes in a state where the sheet metal member and the support member are not fastened by the fastening member.

Further features of the present invention will become apparent from the following description of exemplary embodiments with reference to the attached drawings.

DESCRIPTION OF THE EMBODIMENTS

Image Forming Apparatus

Figure 1:
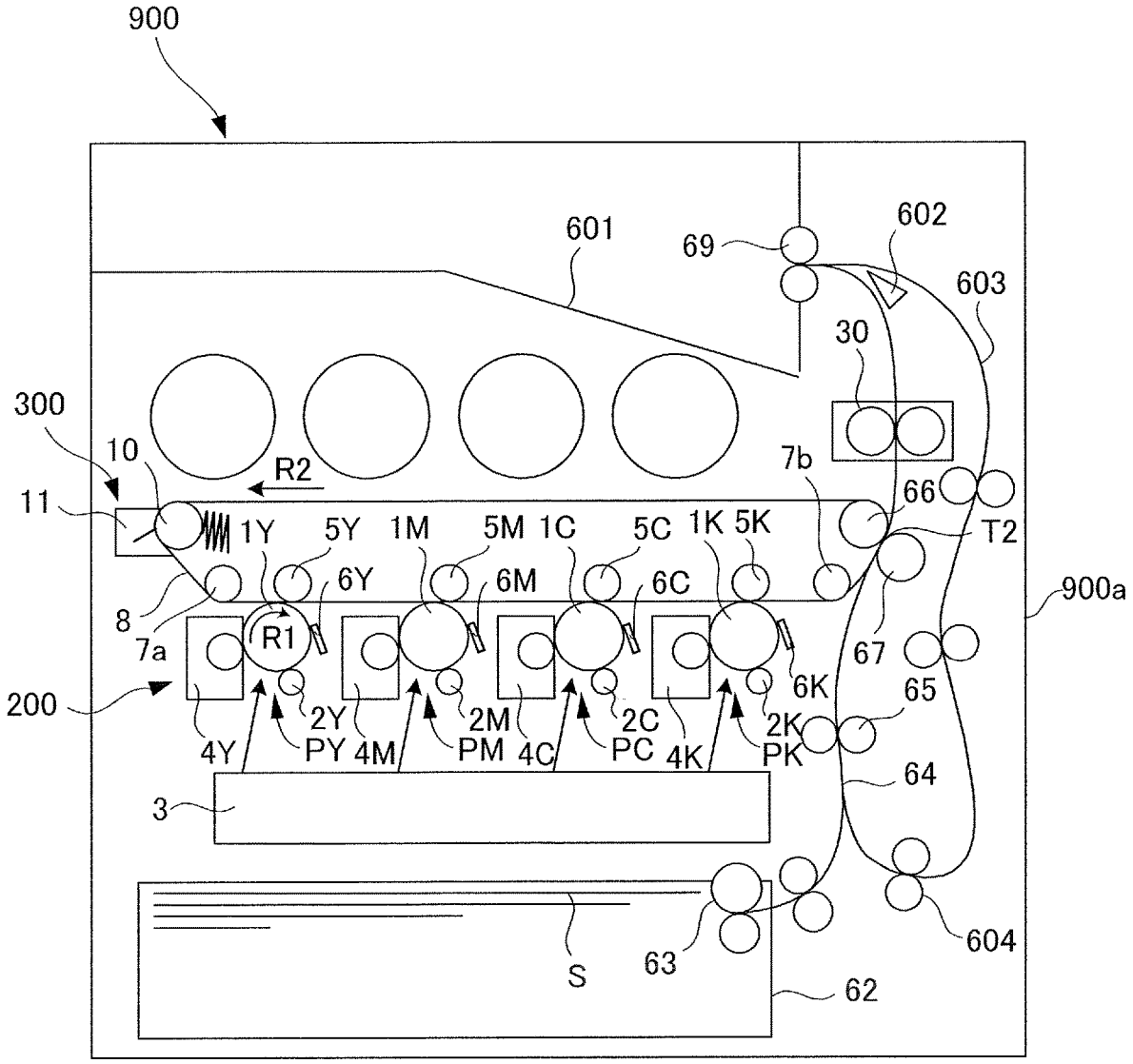
FIG. 1 is a schematic view illustrating a configuration of an image forming apparatus.

Now, a cleaning device according to the present embodiment will be described. At first, an image forming apparatus suitable for adopting the cleaning device according to the present embodiment will be described with reference to FIG. 1. An image forming apparatus 900 illustrated in FIG. 1 is an intermediate transfer tandem-type color image forming apparatus in which image forming units PY, PM, PC and PK of four colors, which are yellow, magenta, cyan and black, are arranged facing an intermediate transfer belt 8 within an apparatus body 900*a*. According to the present embodiment, as described later, a plurality of drum units 200, also referred to as drum cartridges, and a belt unit 300 are detachably attached to the apparatus body 900*a*.

A process for conveying recording materials in the image forming apparatus 900 will now be described. Recording materials S are stored in a stacked state in a cassette 62, and the sheets S are fed one at a time by a sheet feed roller 63 to a sheet conveyance path 64 in correspondence with an image forming timing. Further, recording material S supported on a manual feed tray not shown may be fed one at a time to the sheet conveyance path 64. In a state where the recording material S is conveyed to a registration roller 65 arranged in midway of the sheet conveyance path 64, the sheet S is subjected to skew correction and timing correction by the registration roller 65 before being sent to a secondary transfer portion T2. The secondary transfer portion T2 is a transfer nip portion formed by a secondary transfer inner roller 66 and a secondary transfer outer roller 67 that are opposed to one another. At the secondary transfer portion T2, secondary transfer voltage is applied to the secondary transfer inner roller 66, by which toner image is secondarily transferred from the intermediate transfer belt 8 to the recording material S.

An image forming process of an image sent to the secondary transfer portion T2 at a similar timing as the above-described conveyance process of the recording material S to the secondary transfer portion T2 will be described. At first, the image forming units PY to PK will be described. The image forming units PY to PK adopt a similar configuration except for the difference in toner colors used in developing apparatuses 4Y, 4M, 4C and 4K, which are yellow, magenta, cyan and black. Therefore, in the following description, the yellow image forming unit PY will be described, and the descriptions of other image forming units PM, PC and PK will be omitted.

The image forming unit PY is mainly composed of a photosensitive drum 1Y, a charge roller 2Y, a developing apparatus 4Y, a drum cleaning device 6Y and so on. A surface of the photosensitive drum 1Y being driven to rotate is charged uniformly in advance by the charge roller 2Y, and thereafter, an electrostatic latent image is formed by an exposing unit 3 driven based on an image information signal. Next, the electrostatic latent image formed on the photosensitive drum 1Y is visualized by development using toner by the developing apparatus 4Y. A primary transfer roller 5Y arranged opposed to the image forming unit PY with the intermediate transfer belt 8 interposed therebetween applies predetermined pressure and primary transfer bias, and the toner image formed on the photosensitive drum 1Y is primarily transferred to the intermediate transfer belt 8. The small amount of transfer residual toner remaining on the photosensitive drum 1Y after primary transfer is removed by the drum cleaning device 6Y.

The intermediate transfer belt 8 is stretched across a tension roller 10, the secondary transfer inner roller 66 and stretch rollers 7*a* and 7*b*, and it is driven to move toward a direction of arrow R2 in the drawing. According to the present embodiment, the secondary transfer inner roller 66 also serves as a drive roller that drives the intermediate transfer belt 8. The image forming processes of respective colors performed by the image forming units PY to PK described above are performed at timings determined to sequentially superpose a toner image on a toner image of a different color formed upstream in a direction of movement primarily transferred to the intermediate transfer belt 8. As a result, a full-color toner image is finally formed on the intermediate transfer belt 8 and conveyed to the secondary transfer portion T2. Transfer residual toner having passed the secondary transfer portion T2 is removed from the intermediate transfer belt 8 by a transfer cleaning device 11. In the present embodiment, the transfer cleaning device 11 can adopt a similar configuration as the drum cleaning devices 6Y to 6K.

According to the conveyance process and image forming process described above, the timing of the recording material S is matched with the full-color toner image at the secondary transfer portion T2, and the toner image is secondarily transferred to the recording material S from the intermediate transfer belt 8. Thereafter, the recording material S is conveyed to a fixing unit 30, and the recording material S is subjected to heat and pressure by the fixing unit 30, by which the toner image is melted and fixed to the recording material S. In the case of single-sided printing, the recording material S to which the toner image has been fixed as described is discharged onto a sheet discharge tray 601 by a sheet discharge roller 69 rotated in normal rotation. Meanwhile, in the case of duplex printing, the recording material S is conveyed by the sheet discharge roller 69 rotated in a normal direction until a trailing edge of the recording material S passes a switching member 602, and thereafter, a leading edge and the trailing edge of the recording material S are switched by the sheet discharge roller 69 rotated in a reverse direction, and the recording material S is conveyed to a duplex conveyance path 603. Thereafter, the recording material S is conveyed again to the sheet conveyance path 64 by a sheet feed roller 604. Similar processes as the above-described processes are performed to convey the recording material S thereafter and as the image forming process for a second side thereof, so descriptions thereof are omitted.

Drum Unit

Photosensitive drums 1Y to 1K are organic image bearing members, and as an example, a member having a photosensitive layer of approximately 30 μm on an aluminum cylinder is used. The photosensitive drums 1Y to 1K are each formed, for example, as a cylinder having an outer diameter of 30 mm, and a length of 380 mm in a width direction intersecting the direction of movement of the photosensitive drums 1Y to 1K, or rotational axis direction, and they are driven to rotate in a direction of arrow R1 in the drawing at a rotational speed of 350 mm/s. It is also possible to adopt an amorphous silicon drum and the like as the photosensitive drums 1Y to 1K. In the present embodiment, the photosensitive drum 1Y (1M-1K), the charge roller 2Y (2M-2K) and the drum cleaning device 6Y (6M-6K) are combined for each color and formed as a unit serving as a drum unit 200. Thereby, the user can replace the photosensitive drum 1Y, the drum cleaning device 6Y and so on by replacing the whole drum unit 200. It is also possible to include the developing apparatus 4Y (4M-4K) to the drum unit 200 to form a process unit, and to detachably attach the process unit to the apparatus body 900*a*.

Belt Unit

The intermediate transfer belt 8 serving as an image bearing member is, for example, an endless resin belt formed by dispersing conductive agent, such as carbon black, in resin, such as polyimide (PI) and polyether ether ketone (PEEK). In the present embodiment, the intermediate transfer belt 8, the tension roller 10, the secondary transfer inner roller 66, the stretch rollers 7*a* and 7*b*, primary transfer rollers 5Y to 5K and the transfer cleaning device 11 are formed as a unit serving as the belt unit 300 that is detachably attached to the apparatus body 900*a*. Thereby, the user can replace the intermediate transfer belt 8 and the transfer cleaning device 11 by the whole belt unit 300.

Figure 2A:
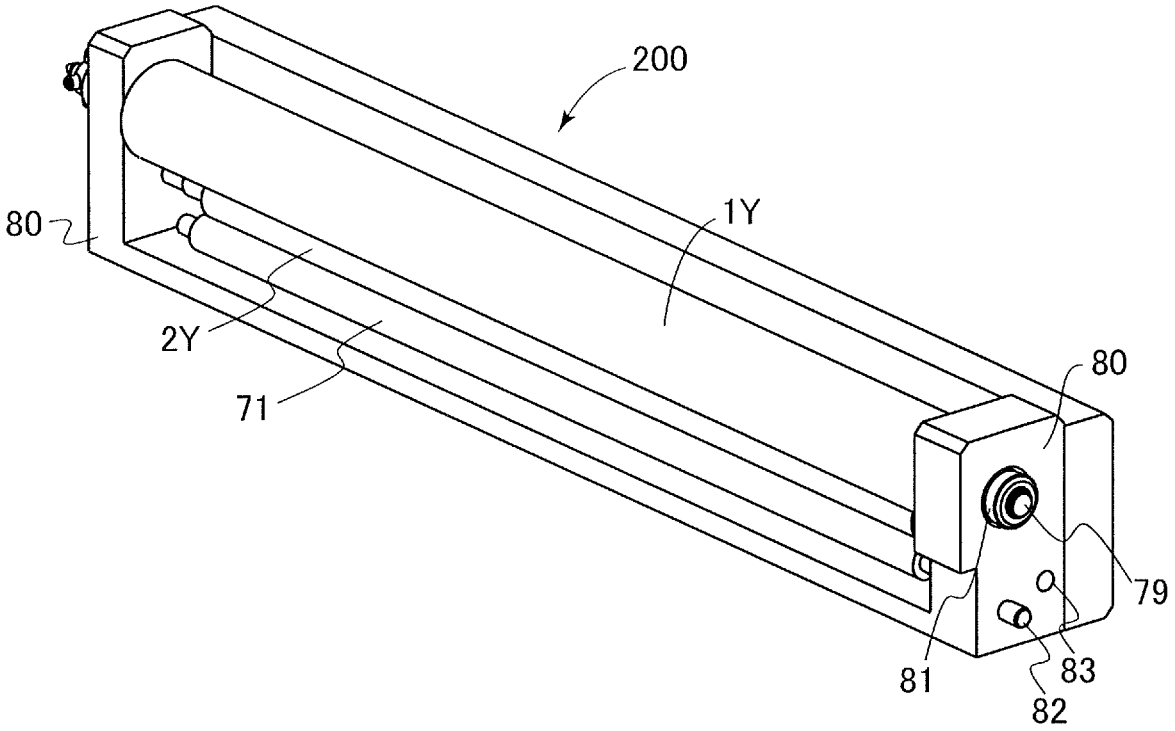
FIG. 2A is a perspective front view illustrating a drum unit.
Figure 2B:
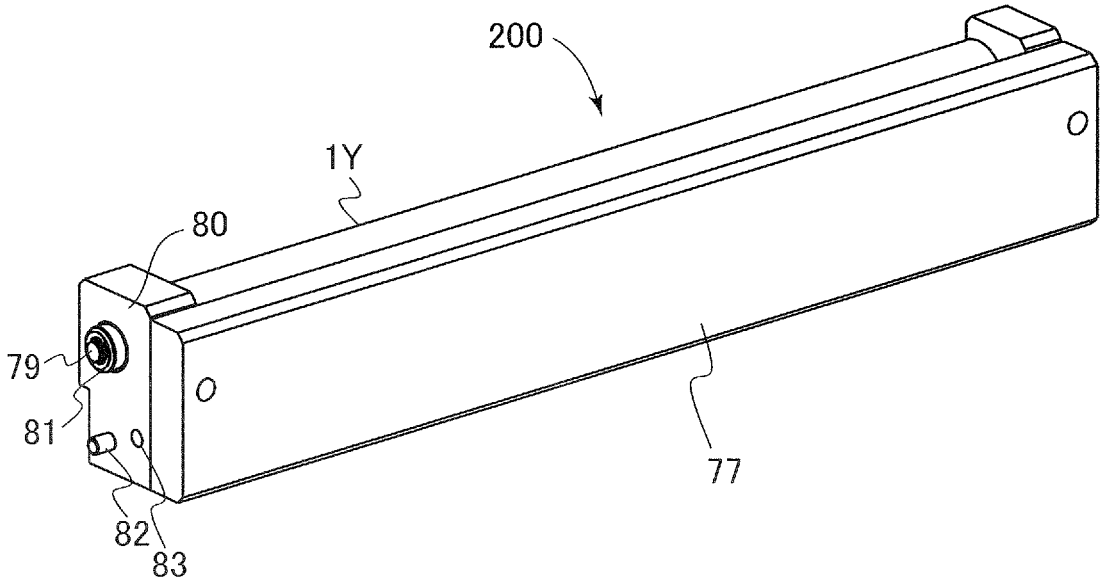
FIG. 2B is a perspective rear view illustrating the drum unit.

The drum unit 200 according to the present embodiment will be described with reference to FIGS. 2A and 2B. As illustrated in FIGS. 2A and 2B, the photosensitive drum 1Y has a metal rotation shaft 79 arranged at a center thereof, which is rotatably supported on a frame member 80 which is approximately U-shaped with both end portions thereof in the width direction erected. Specifically, the rotation shaft 79 is supported on a bearing 81 provided on the frame member 80. The charge roller 2Y is a rubber roller formed of conductive rubber and having an outer diameter of 14 mm and a length in the width direction of 335 mm, for example, and it is supported on the frame member 80 so as to abut against and be rotated by the rotation of the photosensitive drum 1Y. Further, a roller cleaning member 71, which is not shown in FIG. 1, is supported on the frame member 80 so as to abut against and be rotated by the rotation of the charge roller 2Y. The roller cleaning member 71 is a sponge roller having an outer diameter of 11.8 mm and a length in the width direction of 346 mm, for example, and removes toner and toner external additives attached to the charge roller 2Y. Further, the drum cleaning device 6Y is supported on the frame member 80, similarly as the photosensitive drum 1Y and the like (refer to FIG. 3 described later). Further, a boss 82 that protrudes outward from both end portions in the width direction of the frame member 80 is formed. The boss 82 is fit to a fitted portion (not shown) of the apparatus body 900*a*, and thereafter, the frame member 80 is pivoted with the boss 82 serving as the pivot axis, by which the position of the drum unit 200 is determined and fixed to the apparatus body 900*a*.

Drum Cleaning Device

The drum cleaning devices 6Y to 6K will be described with reference to FIGS. 3 and 4. In the following, the drum cleaning device 6Y for cleaning toner from the photosensitive drum 1Y will be described as an example. In the present embodiment, the drum cleaning device 6Y adopts a blade system that mechanically scrapes off toner using a cleaning blade (hereinafter simply referred to as blade). In the present embodiment, the drum cleaning device 6Y is mainly composed of a blade member 73 including a blade 72, a base member 74, and a pressurizing unit 77.

An elastic member such as polyurethane rubber formed into a plate shape is widely used as the blade 72, since it does not damage the photosensitive drum 1Y by friction and has a high wear resistance. It is preferable to adopt a two-liquid thermosetting polyurethane, since it has small residual strain. Alternatively, styrene-butadiene copolymer, chloroprene, butadiene rubber, ethylene-propylene-diene-based rubber, chlorosulfonated polyethylene rubber, fluororubber, silicone rubber and the like can be applied. For example, the blade 72 is formed to have a length in the width direction of 340 mm, a thickness of 2 mm, a length in the short direction of 15 mm, and a stiffness of 70 to 80 Asker C hardness. Further, the length in the width direction of the blade 72 is longer than the width of an area of the surface of the photosensitive drum 1Y where toner image can be formed.

In the case of the present embodiment, the blade 72, so-called adhesion type blade, is adhered onto the blade member 73 formed of sheet metal, i.e., sheet metal member, formed in an approximately L-shape, with a length of a free end thereof of 8 mm, for example. The blade member 73 includes an adhesion portion 73*a* to which the blade 72 is adhered, and a supported portion 73*b* supported on the base member 74. The adhesion portion 73*a* and the supported portion 73*b* are mutually orthogonal. The base member 74 serving as a support member is capable of supporting the blade member 73 toward an oblique upward direction such that the blade 72 abuts against the photosensitive drum 1Y in a counter direction with respect to the direction of rotation of the photosensitive drum 1Y, i.e., direction of arrow R1 in the drawing. As described in detail later, the blade member 73 is supported swingably toward the photosensitive drum 1Y on the base member 74 with a center portion in the width direction serving as a center of swing, until the blade member 73 is fastened to the base member 74 by screws and the like. The blade member 73 can also be formed as a molded member in which the blade member 73 and the blade 72 are molded integrally, by inserting a sheet metal constituting the blade member 73 to a mold, and pouring material such as rubber for forming the blade 72 in the mold. The integrally molded member is advantageous in that the blade 72 is not easily peeled off compared to the adhesion type.

The base member 74 includes a blade attaching surface 74*a* for attaching the blade member 73 via the supported portion 73*b*, and erected portions 74*b* erected at both end portions in the width direction of the blade attaching surface 74*a* in a manner opposed to one another. Each erected portion 74*b* is capable of receiving insertion of a pin-shaped supporting rod 78, which can be a round rod having a diameter of 4 mm, and the base member 74 is attached pivotably on the frame member 80 around the supporting rod 78 serving as shaft, that is, pivot axis. The pressurizing unit 77 is provided to allow the base member 74 to pivot. The pressurizing unit 77 includes a pressurizing portion 75, a pressurizing plate 76 and a compression spring not shown, wherein the pressurizing portion 75 is attached to the pressurizing plate 76. The pressurizing plate 76 is fixed to the frame member 80, and the pressurizing portion 75 is abutted against the blade member 73. The pressurizing portion 75 is urged by a compression spring not shown so as to pivot the base member 74 around the supporting rod 78 and have the blade 72 contact the photosensitive drum 1Y with pressure. In the case of the present embodiment, the blade member 73 is pressed with a force of approximately 1 kgf, for example, by the pressurizing unit 77.

The blade 72 is caused to be in pressure contact with the photosensitive drum 1Y at a predetermined angle, so-called abutting angle, by the pressurizing unit 77. According to the present embodiment, as illustrated in FIG. 4, an angle formed by the blade 72 in a non-deformed, abutted state and a tangent D of the photosensitive drum 1Y that passes a contact T of a tip portion, i.e., edge, of the blade 72 abutted against the photosensitive drum 1Y in a non-deformed state is referred to as an abutting angle $\alpha$. If the abutting angle $\alpha$ is too small, frictional force with the photosensitive drum 1Y becomes too small, and the blade 72 cannot sufficiently scrape off the toner remaining on the photosensitive drum 1Y, so that a desirable cleaning effect cannot be obtained. Meanwhile, if the abutting angle $\alpha$ is too large, friction against the photosensitive drum 1Y is increased, and a turning over phenomenon of the blade in which the tip portion of the blade 72 is turned over to the direction of rotation of the photosensitive drum 1Y may occur. In order to overcome these drawbacks, the abutting angle $\alpha$ is set within the range of 10 to 40 degrees, and more preferably, within the range of 20 to 30 degrees. According to the present embodiment, the abutting angle $\alpha$ is set to 23.5 degrees.

As described above, the blade 72 is swung by the pressurizing unit 77 and is in pressure contact with the photosensitive drum 1Y, wherein the force applied by the blade 72 to the photosensitive drum 1Y during pressure contact is called blade pressure. Blade pressure has a preferable setting range, similar to the abutting angle $\alpha$ described above, and in a state where the blade pressure is low, toner on the photosensitive drum 1Y cannot be sufficiently scraped off by the blade 72, and a desired cleaning effect cannot be achieved. Meanwhile, if the blade pressure is high, frictional force with the photosensitive drum 1Y is increased and turning over of the blade described above tends to be caused. In addition, if the blade pressure is high, the surface of the photosensitive drum 1Y tends to be scraped away, and if the surface is scraped away, toner fusion on the surface of the photosensitive drum 1Y or image streaks may occur, and the replacement cycle of the photosensitive drum 1Y may be shortened. In order to prevent this drawback, the blade pressure is set within a range of 600 to 1200 gf, but the preferable blade pressure depends on the length of the free end of the blade 72 or the hardness thereof. In the present embodiment, the blade pressure is set to 900 gf. The blade pressure should preferably be uniform in the width direction of the blade 72.

By setting the above-described blade pressure and the abutting angle $\alpha$ to fall within a preferable range, desired cleaning effect can be achieved, and shortening of life of the photosensitive drum 1Y by surface scraping can be suppressed. Hitherto, however, even if the blade pressure is set to a preferable range, actually the blade pressure could not be set uniformly since a straight line passing a center of cross section of the supporting rod 78 of FIG. 3 is deviated from the rotational axis of the photosensitive drum 1Y (deviation between base lines) due to component tolerance and the like. In that case, blade pressure is caused to differ in the width direction of the blade 72, and scraping off of the surface of the photosensitive drum 1Y is accelerated at the area where blade pressure is high, and uneven wear of the photosensitive drum 1Y occurs, so that the life of the photosensitive drum 1Y is shortened compared to a case where a uniform blade pressure is realized. Further, blade pressure is influenced by positional deviation of the frame member 80, load variation on the blade 72 by the pressurizing unit 77, variation of hardness and shape of the blade 72, the outer diameter run-out of the photosensitive drum 1Y during rotation and so on, so that it was difficult to realize a uniform blade pressure.

Therefore, according to the present embodiment, by regulating the position of the blade 72 in the width direction, a blade pressure uniform in the width direction can be set under a condition where the pressurizing force by the pressuring unit 77 on the blade 72 is the same. Now, a method for manufacturing the drum cleaning device 6Y and the drum cleaning device 6Y manufactured in this manner will be described with reference to FIG. 3 and based on FIGS. 5 through 15. According to the present embodiment, the drum cleaning device 6Y is manufactured using a manufacturing apparatus 100.

Figure 5:
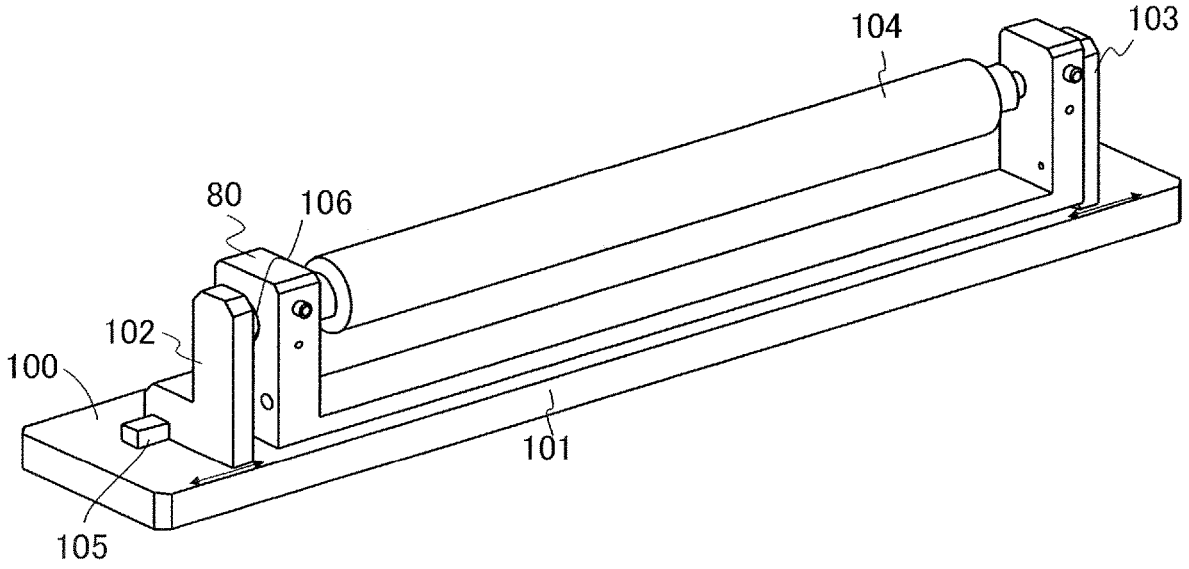
FIG. 5 is a perspective view illustrating a state in which a frame member is attached to a manufacturing apparatus.

FIG. 5 illustrates a state where the frame member 80 of the drum unit 200 is mounted to the manufacturing apparatus 100. As illustrated in FIG. 5, the manufacturing apparatus 100 includes a base 101, a first frame member retaining portion 102, a second frame member retaining portion 103, and a regulating cylindrical portion 104. The first frame member retaining portion 102 and the second frame member retaining portion 103 are retained movably in a parallel direction by a linear guide 105 provided on the base 101 such that distance therebetween can be widened or narrowed. A projected positioning portion 106 for retaining the frame member 80 is formed to each of the first frame member retaining portion 102 and the second frame member retaining portion 103. The regulating cylindrical portion 104 is a cylindrical member formed to have approximately the same diameter as the photosensitive drum 1Y and corresponds to the photosensitive drum 1Y formed of stainless steel, and it is detachably attached to the frame member 80, similar to the photosensitive drum 1Y. The positioning portion 106 is formed at a position determined such that the attachment state of the regulating cylindrical portion 104 to the frame member 80 is the same as the attachment state of the photosensitive drum 1Y.

At first, the user moves the first frame member retaining portion 102 and the second frame member retaining portion 103 of the manufacturing apparatus 100 outward in parallel with each other to widen the distance therebetween, and then places the frame member 80 on the base 101. Thereafter, the user moves the first frame member retaining portion 102 and the second frame member retaining portion 103 of the manufacturing apparatus 100 inward in parallel with each other to narrow the distance therebetween. Thereby, the frame member 80 is positioned by the positioning portion 106, clamped by the first frame member retaining portion 102 and the second frame member retaining portion 103, and fixed to the manufacturing apparatus 100. The user fixes the frame member 80 to the manufacturing apparatus 100 and attaches the regulating cylindrical portion 104 to the frame member 80.

According to the manufacturing method of the present embodiment, as described later, the regulating cylindrical portion 104 is used to abut the blade 72 against the regulating cylindrical portion 104 and regulate the position of the blade 72, so the surface of the regulating cylindrical portion 104 should preferably be processed highly accurately. Further, it is preferable for the regulating cylindrical portion 104 to have the same level of outer diameter tolerance and run-out tolerance as the photosensitive drum 1Y. Moreover, in order to reduce damages on the edge of the blade 72, it is preferable for the regulating cylindrical portion 104 to be retained rotatably on the frame member 80.

Figure 6:
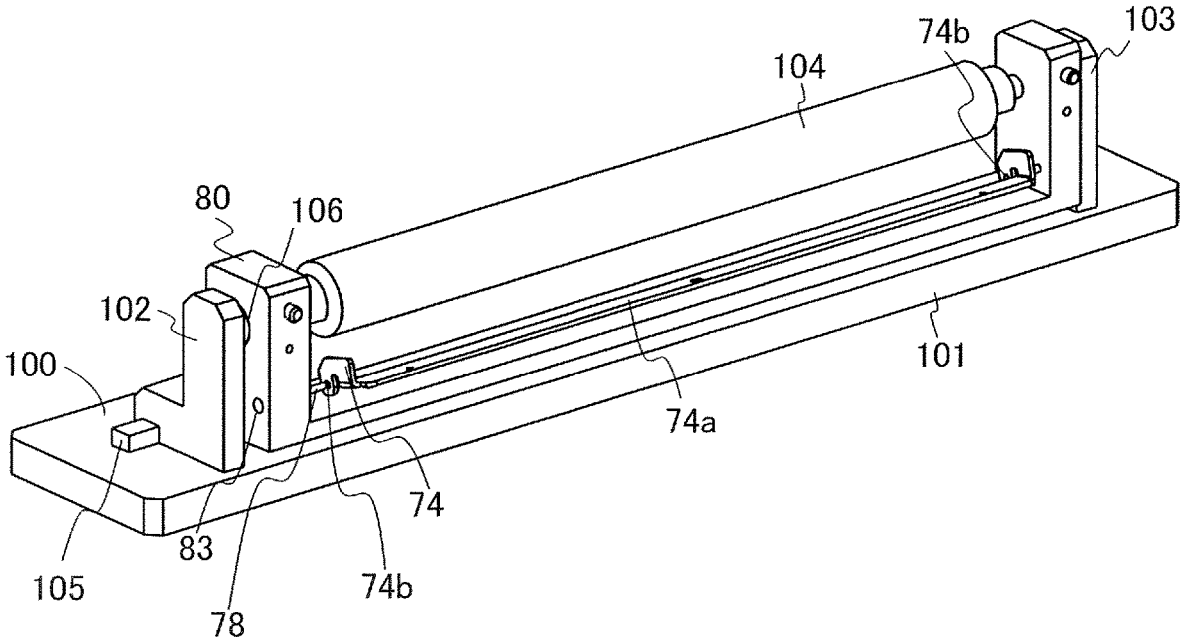
FIG. 6 is a perspective view illustrating a state in which a base member is attached to a manufacturing apparatus.

FIG. 6 illustrates a state where the base member 74 is attached to the manufacturing apparatus 100. The user attaches the base member 74 to the frame member 80. Specifically, the user inserts the pin-shaped supporting rod 78 through a supporting portion retaining hole 83 formed on the frame member 80 and attaches the base member 74 pivotably to the frame member 80.

Figure 7:
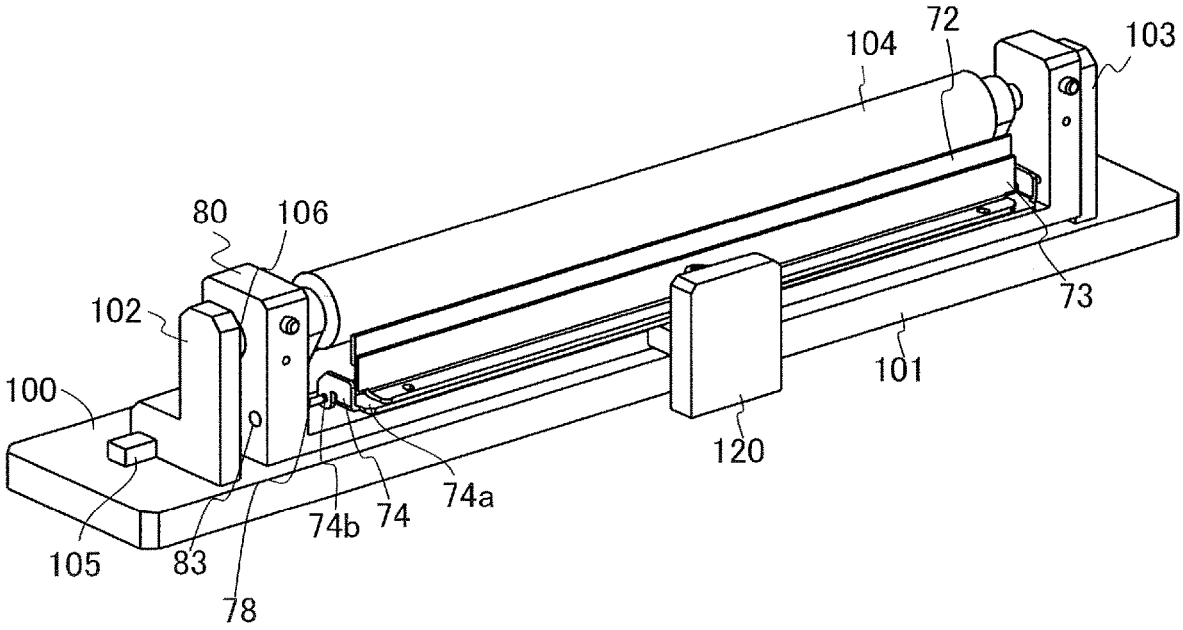
FIG. 7 is a perspective view illustrating a state in which a blade member is attached to the manufacturing apparatus.
Figure 8:
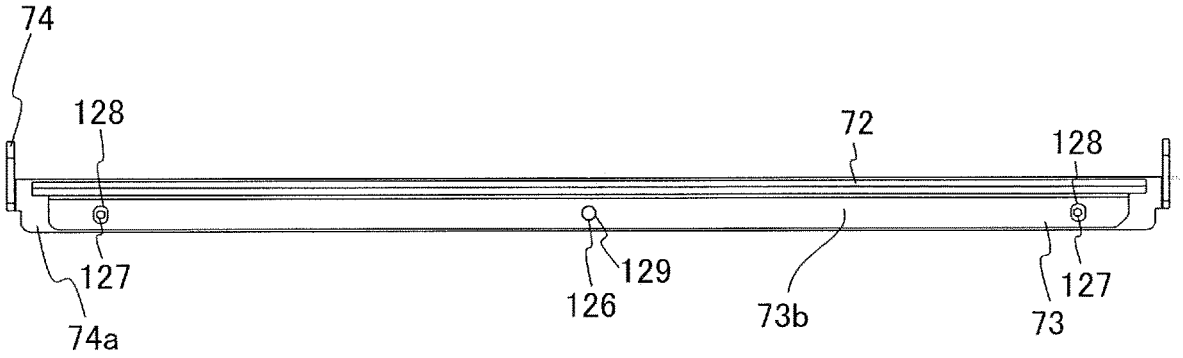
FIG. 8 is a top view illustrating the base member and the blade member in a state installed on a jig.

FIG. 7 illustrates a state where the blade member 73 is attached to the manufacturing apparatus 100. The user superposes the blade attaching surface 74*a* of the base member 74 and the supported portion 73*b* of the blade member 73 (refer to FIG. 3) such that they are abutted against one another, and stacks the blade member 73 on the base member 74. Now, as illustrated in FIG. 8, the base member 74 includes a first center hole 129 formed at a center portion in the width direction, and fastening member receiving portions 127, i.e., tapped holes, for fastening the screw described above formed closed to end portions in the width direction than the center portion in the width direction. Meanwhile, a second center hole 126 is formed at a position superposed with the first center hole 129 with respect to the width direction to the blade member 73, in detail, the supported portion 73*b*. Further, through holes 128 are formed at positions close to end portions in the width direction than the second center hole 126, so that they are partially overlapped with the fastening member receiving portions 127 of the base member 74. In the case of the present embodiment, the fastening member receiving portions 127, i.e., the first fastening member receiving portion and the second fastening member receiving portion, and the through holes 128, i.e., the first and second through holes, are respectively positioned at symmetric positions in which the center position in the width direction where the first and second center holes 129 and 126 are formed is set as reference. The first center hole 129 and the second center hole 126 are formed to have substantially the same size and shape, and as described later, swinging of the blade member 73 with respect to the base member 74 in a swinging direction is permitted in a state where it is not fastened by the screw. The through holes 128 are long holes that are formed along a curved line with the first center hole 129 and the second center hole 126 serving as the center of swing.

As illustrated in FIG. 7, according to the present embodiment, a jig 120 is used to approximately match the fastening member receiving portions 127 and the through holes 128 when placing the blade member 73 on the base member 74 in an appropriate manner. Further, in a state where the fastening member receiving portions 127 and the through holes 128 correspond, the jig 120 is used to retain the base member 74 and the blade member 73 swingably. The jig 120 will be described with reference to FIGS. 9 and 10.

Figure 9:
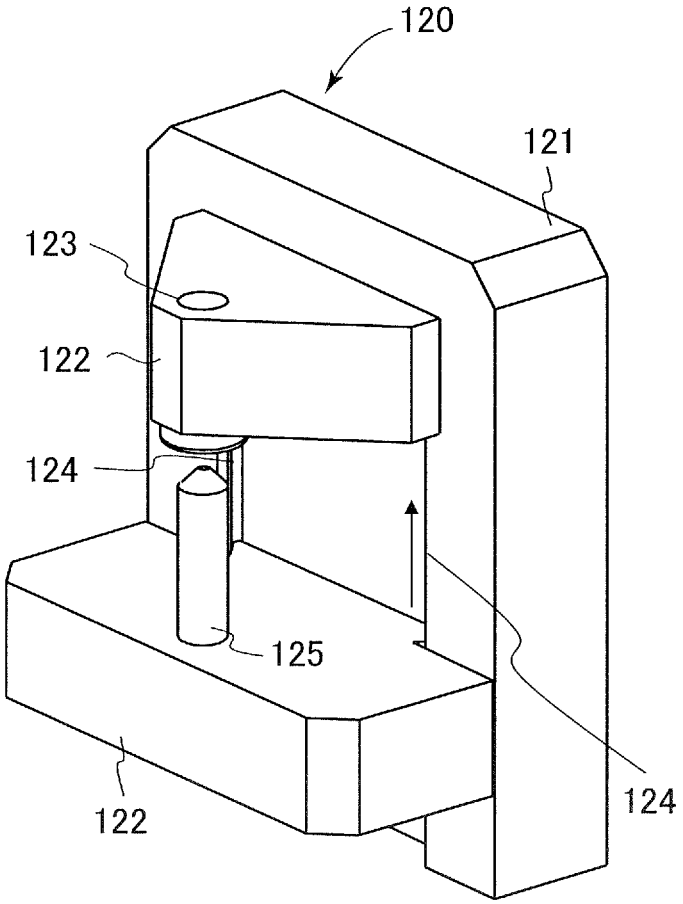
FIG. 9 is a perspective view illustrating the jig.

As illustrated in FIG. 9, the jig 120 includes a base portion 121 and clamping portions 122. A slide retaining portion 124 for slidably retaining the clamping portions 122 to vary the distance between the clamping portions 122 is formed to the base portion 121. In this example, an example is illustrated where the distance between clamping portions 122 is changed by the clamping portion 122 abutted against the base member 74 being moved in sliding motion from a lower side in a vertical direction upward in the vertical direction. A pin portion 125 and a retaining hole 123 are formed to the clamping portions 122. The pin portion 125 and the retaining hole 123 are arranged such that when the distance between the clamping portions 122 is narrowed, the pin portion 125 is inserted to the retaining hole 123.

Figure 10:
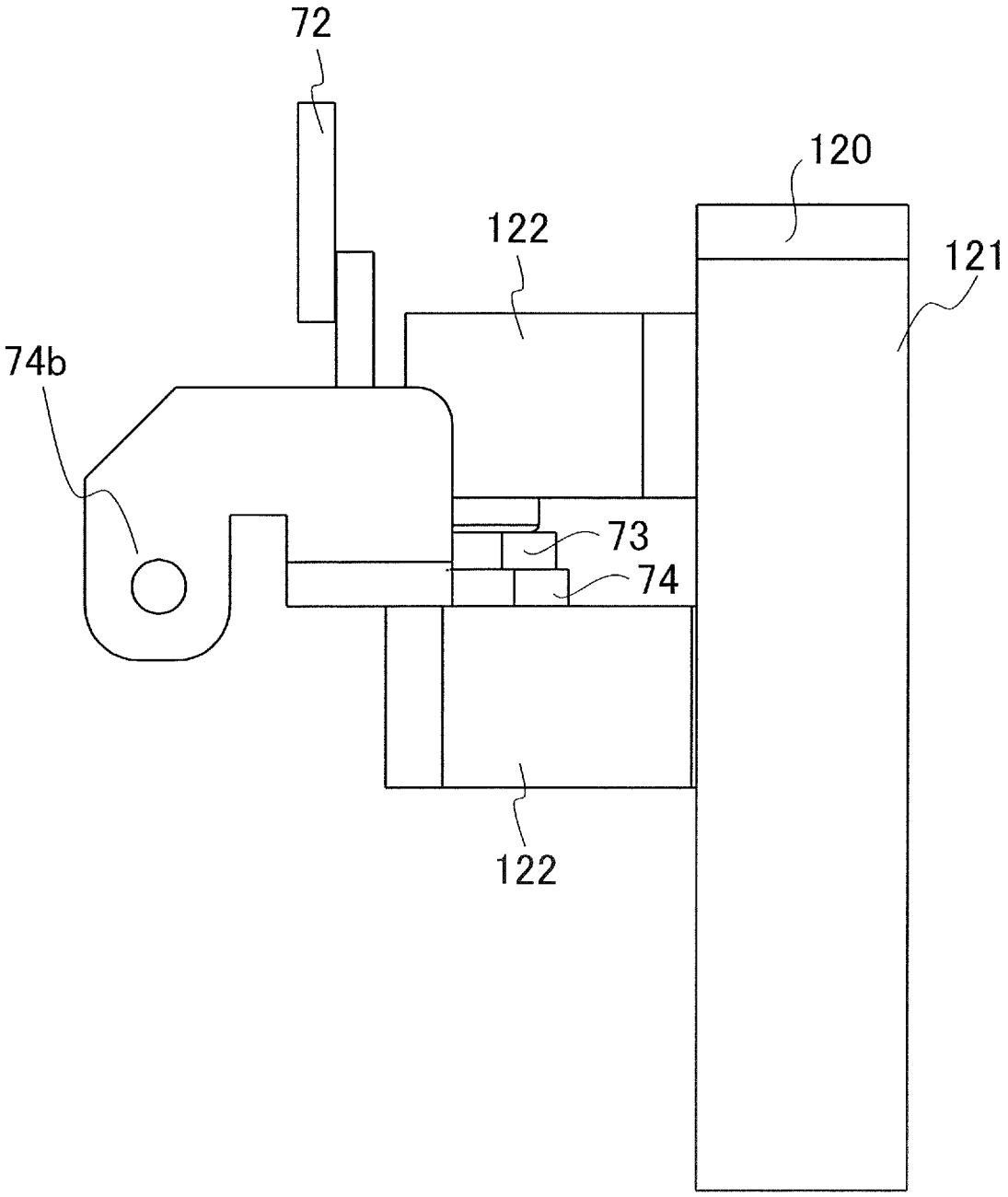
FIG. 10 is a side view illustrating the base member and the blade member in a state clamped by the jig.

The user installs the base member 74 on the jig 120 by inserting the pin portion 125 to the first center hole 129 of the base member 74 in a state where the pin portion 125 is not inserted to the retaining hole 123, as illustrated in FIG. 9 (first step). The base member 74 can be installed on the jig 120 in a state attached to the frame member 80, or it can be attached to the frame member 80 in a state installed on the jig 120. Then, the second center hole 126 of the blade member 73 is inserted to the pin portion 125 of the jig 120 to which the base member 74 has been installed, by which the blade member 73 is installed (second step). Thereafter, as illustrated in FIG. 10, the user slides the clamping portion 122 so that the base member 74 and the blade member 73 are clamped by the clamping portions 122 (third step). That is, in a state where the base member 74 and the blade member 73 are installed on the jig 120, the user slides the lower side clamping portion 122 in the vertical direction upward in the vertical direction so as to narrow the distance between the clamping portions 122. In this state, the pin portion 125 and the retaining hole 123 are connected. According to the present embodiment, the clamping portions 122 nip the base member 74 and the blade member 73 so that the blade member 73 is swingable with respect to the base member 74.

Figure 11:
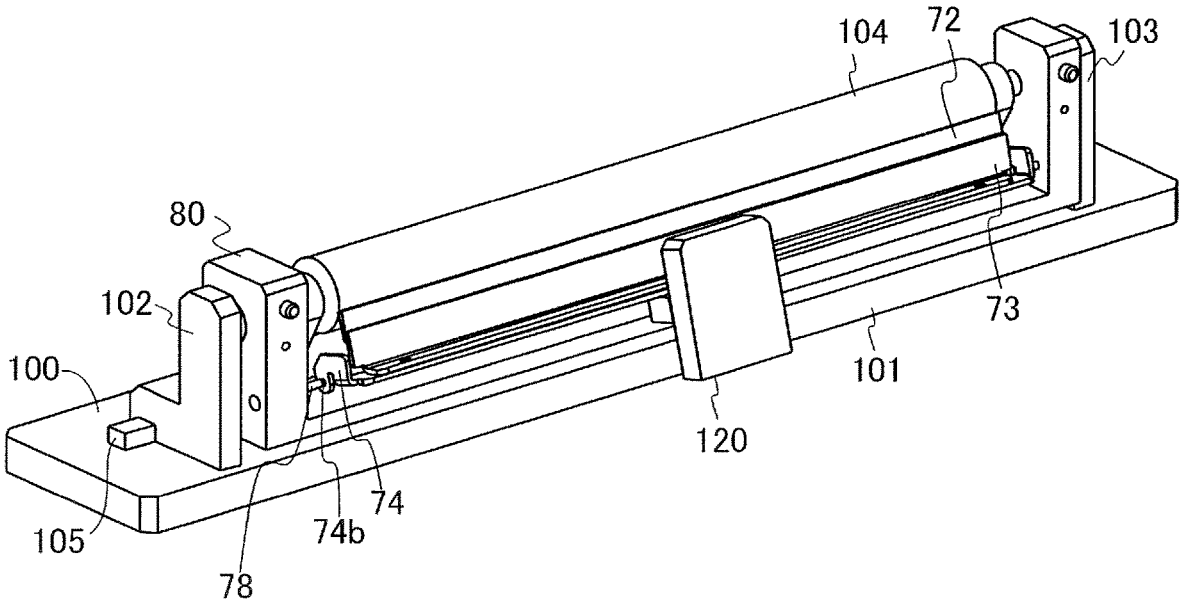
FIG. 11 is a perspective view illustrating a regulation of blade position.
Figure 12:
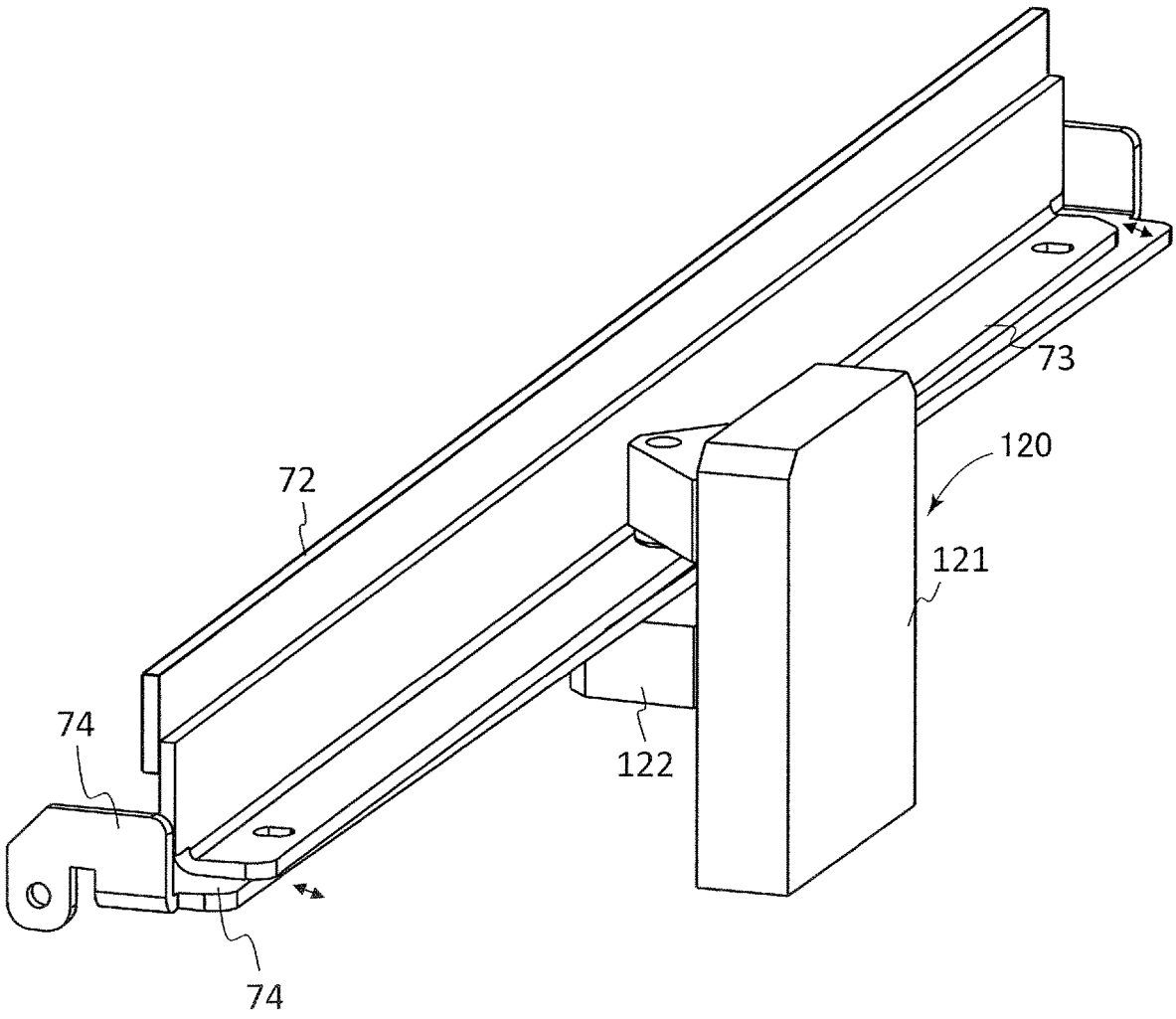
FIG. 12 is an enlarged view illustrating the regulation of blade position.

Next, the regulation of position of the blade 72 will be described with reference to FIGS. 11 and 12. In a state where the blade member 73 and the base member 74 installed on the jig 120 are not fastened, as illustrated in FIG. 11, the user swings the blade member 73 with respect to the base member 74, with the first center hole 129 and the second center hole 126 (refer to FIG. 8) serving as the center of swing (fourth step). Specifically, the blade member 73 swings when the user applies a force to the jig 120 in a direction pivoting the base member 74 around the supporting rod 78. Swinging of the blade 72 is suppressed in a state where the blade 72 is abutted against the regulating cylindrical portion 104. In this state, as illustrated in FIG. 12, the blade member 73 swings, and the position of the blade 72 is regulated to a position where the blade pressure becomes uniform in the width direction. According to the present embodiment, the first center hole 129 and the second center hole 126 are regulating holes for regulating the position of the blade 72 in the width direction.

Figure 13:
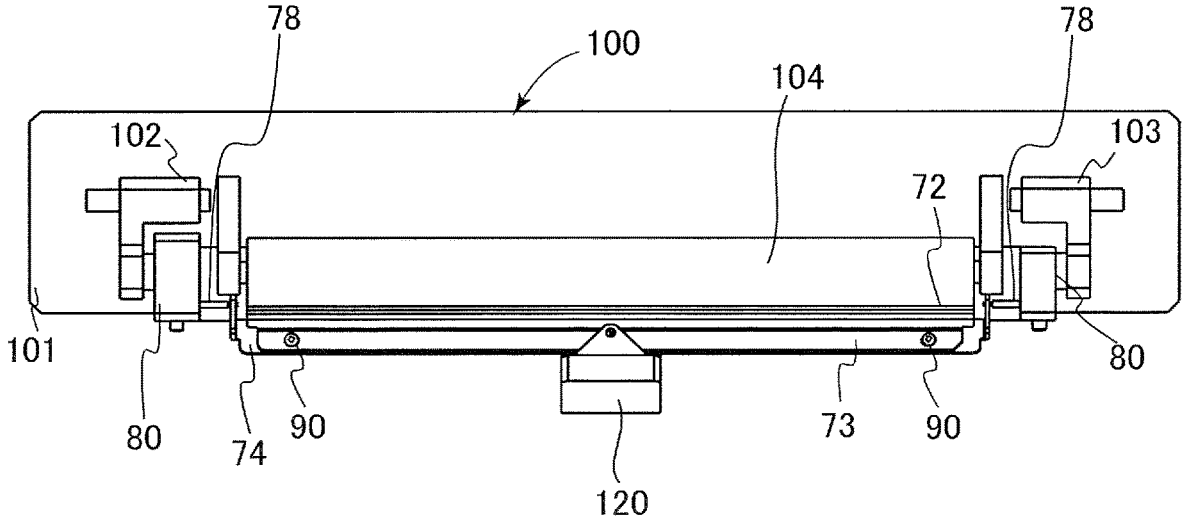
FIG. 13 is a top view illustrating the base member and the blade member in a state fixed by screws.

Then, in a state where the blade 72 is abutted against the regulating cylindrical portion 104 and swinging of the blade member 73 is suppressed, the user inserts screws to the through holes 128 of the blade member 73 (refer to FIG. 8), and fastens the screws to the fastening member receiving portions 127 of the base member 74 (refer to FIG. 8) (fifth step). FIG. 13 illustrates the base member 74 and the blade member 73 in a state fixed by screws 90. According to the present embodiment, the screws 90 serving as fastening members, i.e., first fastening member and second fastening member, are capable of being inserted and fastened to the through holes 128 in a predetermined direction from the side of the blade member 73 toward the side of the base member 74. Thereby, the blade member 73 arranged on an upstream side in the predetermined direction is fixed in a non-swingable manner to the based member 74 arranged on a downstream side in the predetermined direction.

Figure 14:
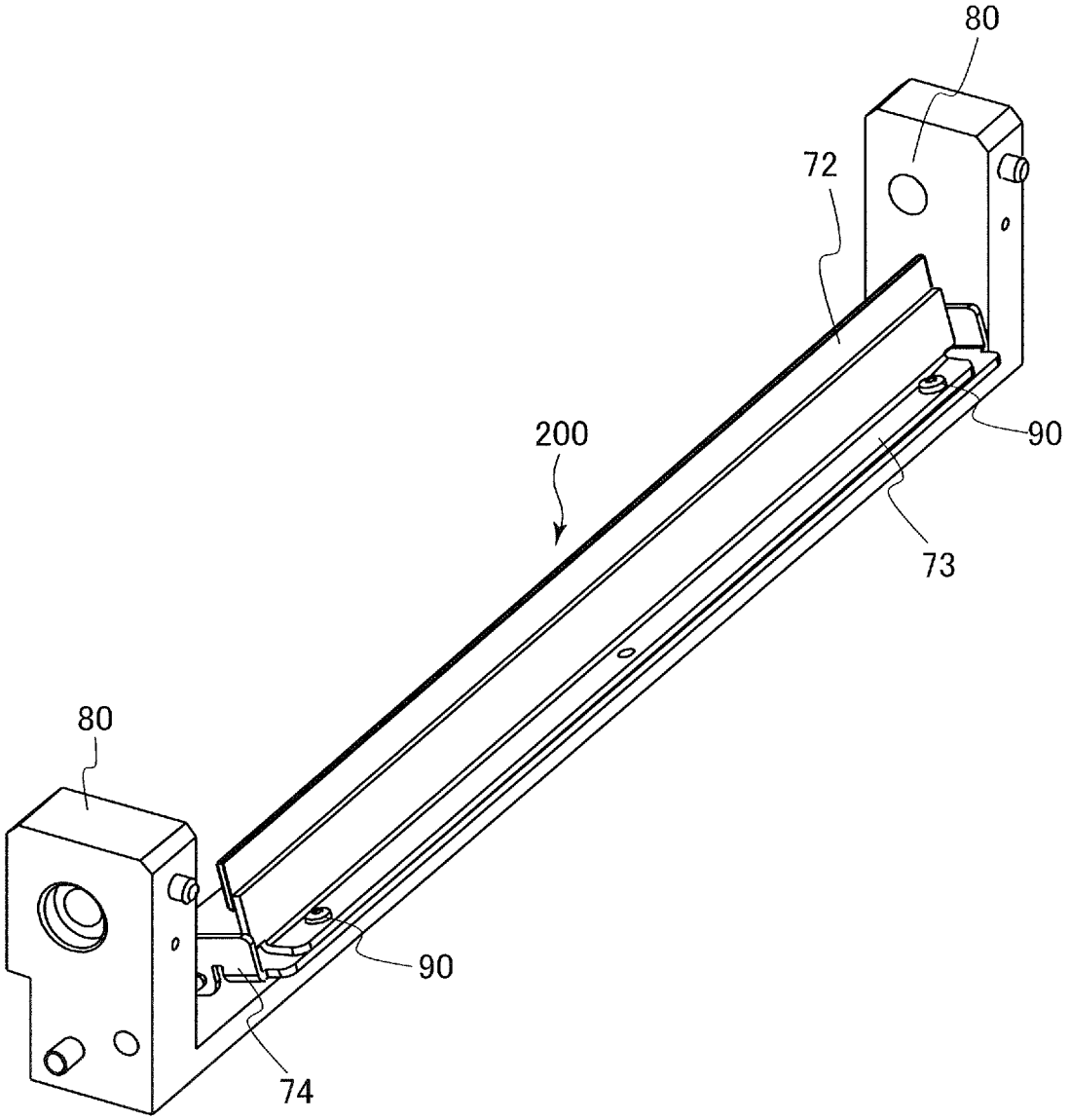
FIG. 14 is a perspective view illustrating a drum unit removed from the manufacturing apparatus.

After fixing the blade member 73 to the base member 74 in a non-swingable manner by screws 90 as described above, the user removes the drum unit 200 (refer to FIG. 14) from the manufacturing apparatus 100. With reference to FIG. 11, at first, the user removes the jig 120 and the regulating cylindrical portion 104. Thereafter, the user moves the first frame member retaining portion 102 and the second frame member retaining portion 103 of the manufacturing apparatus 100 in parallel toward the outer direction, thereby widening the distances therebetween. Then, the user can remove the drum unit 200 from the manufacturing apparatus 100. FIG. 14 illustrates the drum unit 200 removed from the manufacturing apparatus 100.

Figure 3:
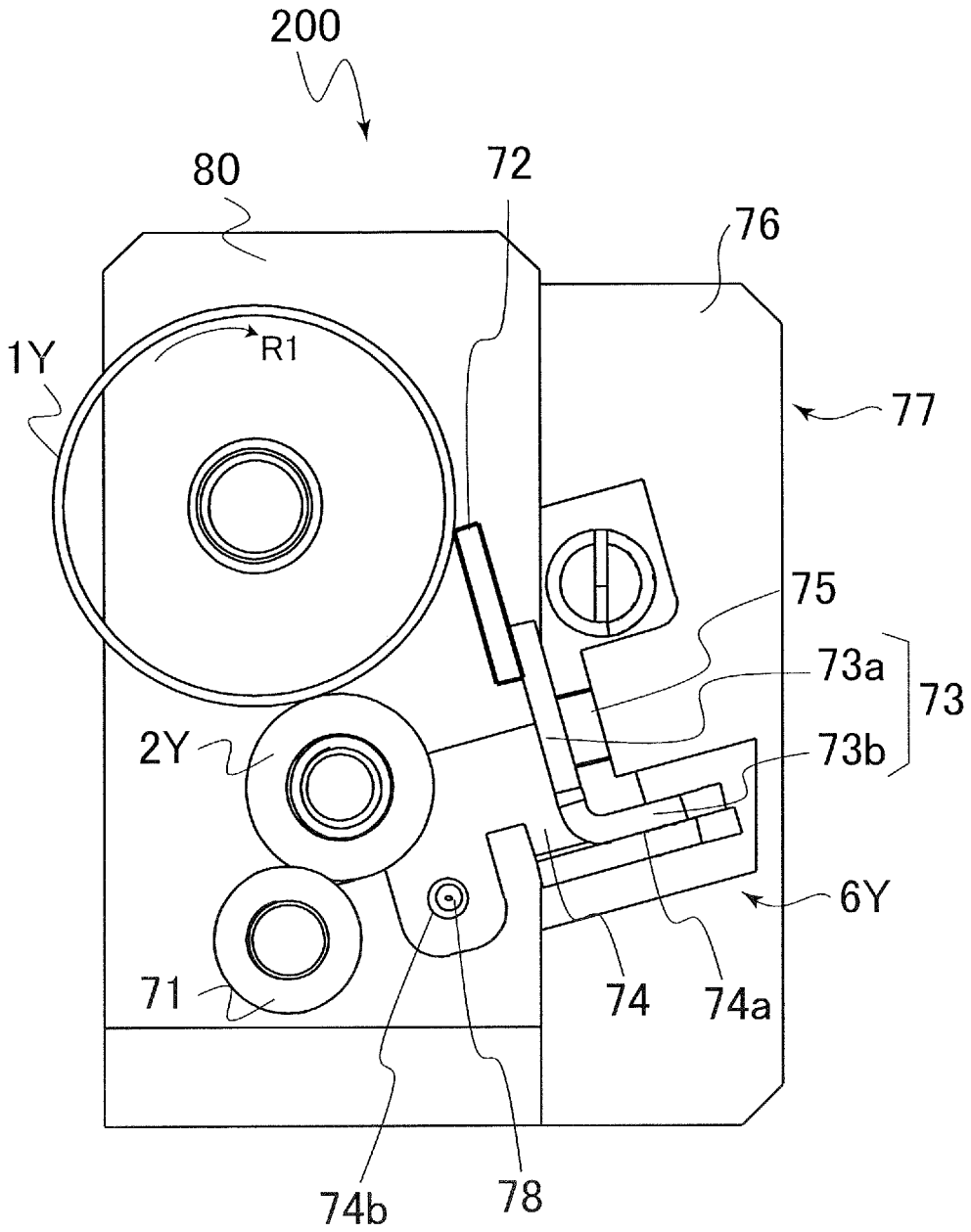
FIG. 3 is a cross-sectional view illustrating the drum unit.
Figure 4:
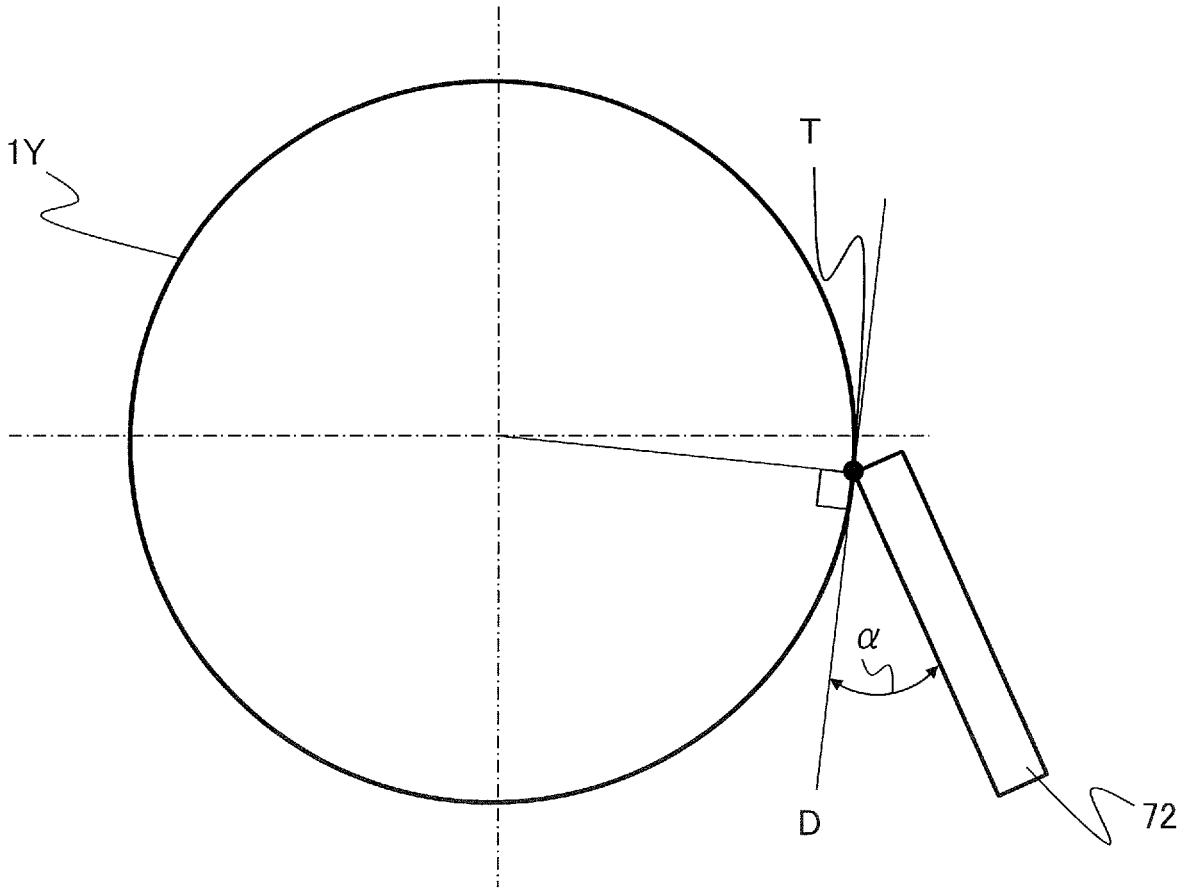
FIG. 4 is a frame format illustrating an abutting angle of a blade to a photosensitive drum.
Figure 15:
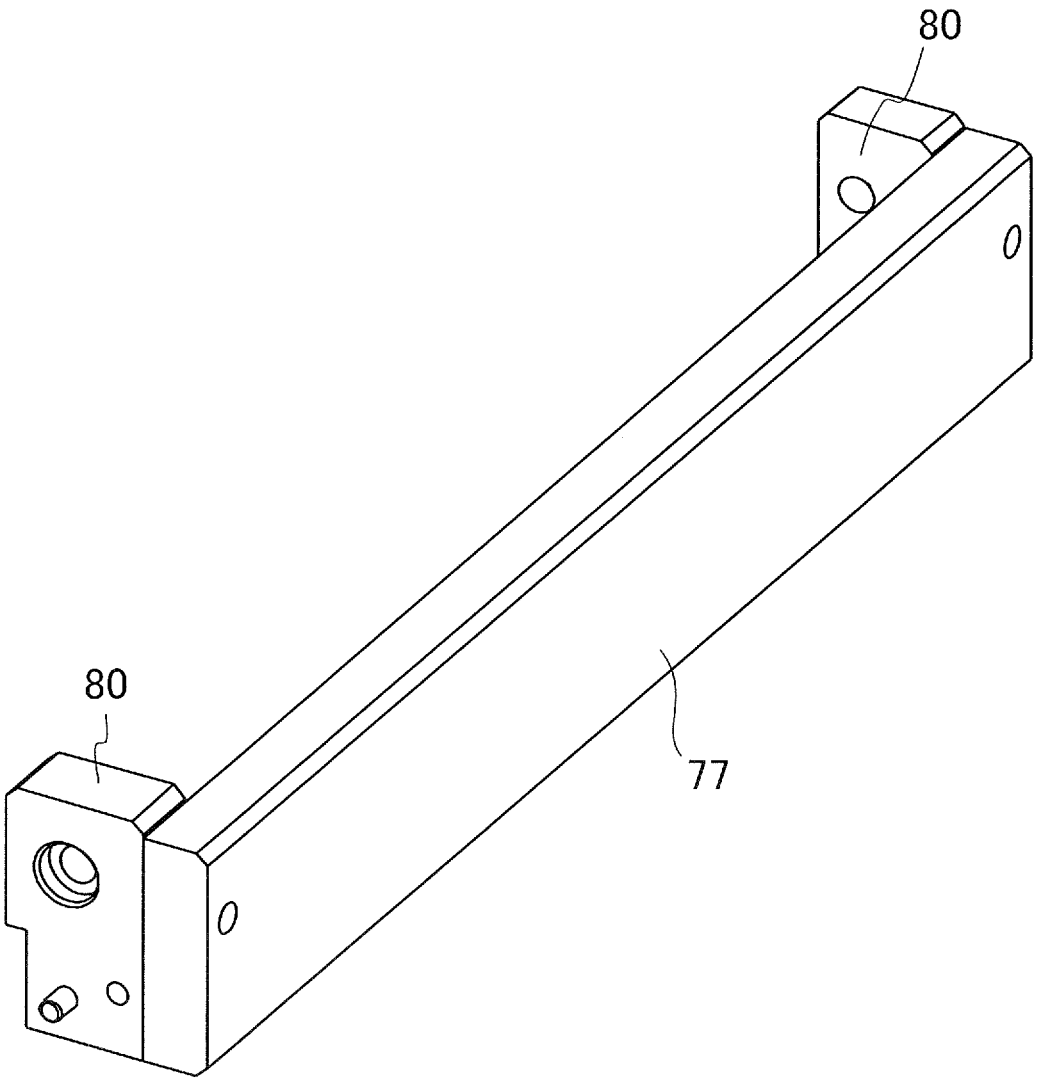
FIG. 15 is a perspective view illustrating a state where a pressurizing unit is attached to the drum unit removed from the manufacturing apparatus.

As illustrated in FIG. 14, at the point of time when the drum unit 200 is removed from the manufacturing apparatus 100, the drum unit 200 does not include the pressurizing unit 77, the photosensitive drum 1Y and the charge roller 2Y (refer to FIG. 3). Therefore, the user attaches the pressurizing unit 77 to the removed drum unit 200. FIG. 15 illustrates a state where the pressurizing unit 77 is attached to the drum unit 200 that has been removed from the manufacturing apparatus 100. After attaching the pressurizing unit 77, the user attaches the photosensitive drum 1Y, the charge roller 2Y and so on to complete the drum unit 200.

By attaching the pressurizing unit 77 in this manner, the base member 74 can be pivoted to thereby abut the blade 72 against the photosensitive drum 1Y. In the present embodiment, as illustrated in FIG. 14, since the blade 72 and the blade member 73 are fixed to the base member 74 that is swingably attached to the frame member 80, the blade 72 and the blade member 73 swing together with the pivoting of the base member 74. In this state, even when the blade 72 is swung, the blade 72 is maintained at the regulated position. Therefore, the blade 72 is abutted against the photosensitive drum 1Y in a state where the tip portion on the free end side is maintained in the width direction. Thereby, the blade 72 will abut against the photosensitive drum 1Y by uniform blade pressure.

Regulation of position of the blade 72 illustrated above will be described with reference to FIGS. 16A to 17C. In FIGS. 16A through 17C, only the regulating cylindrical portion 104 of the manufacturing apparatus 100 is illustrated, and only the pin portion 125 of the jig 120 is illustrated.

Figure 16C:
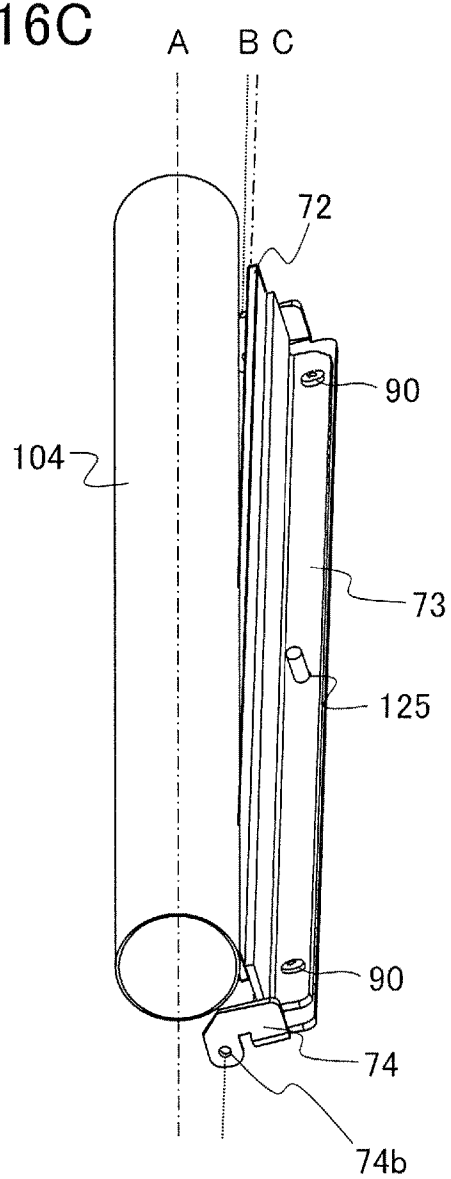
FIG. 16C is a perspective view illustrating a state where the blade member is fastened to the base member in a state deviated from the base line.
Figure 16B:
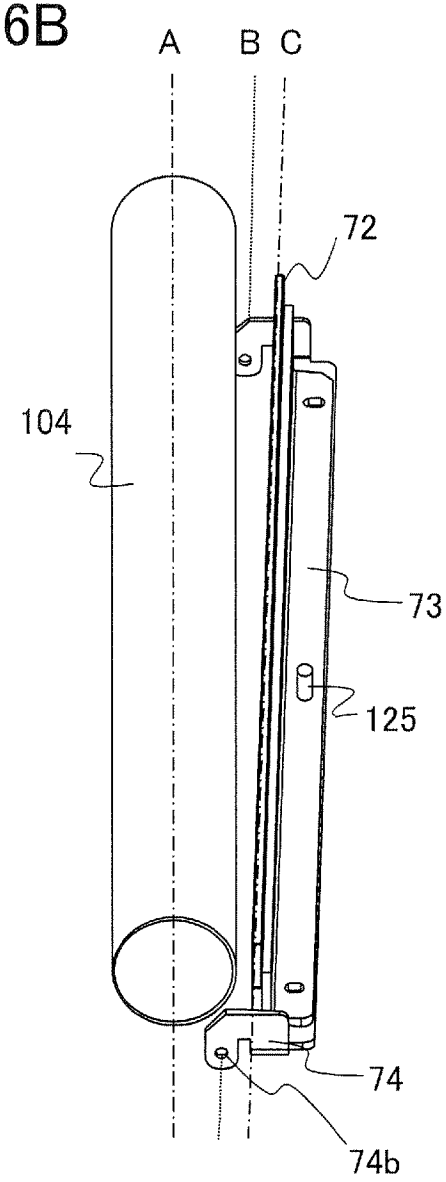
FIG. 16B is a perspective view illustrating a state deviated from a base line prior to regulating position.
Figure 16A:
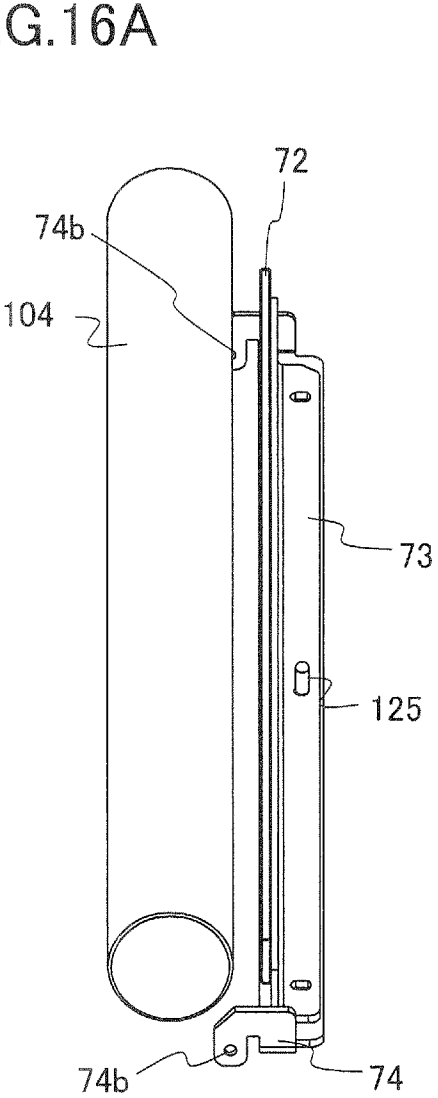
FIG. 16A is a perspective view illustrating a state where the blade member and the base member are installed on the jig.

FIG. 16A illustrates a state where the blade member 73 and the base member 74 are installed on the jig 120 (refer to the first step described above and FIG. 7). FIG. 16B illustrates a state where the blade 72 is deviated from the base line prior to position regulation. In the drawing, dot and dash line A represents a base line of the regulating cylindrical portion 104, dash line B represents a straight line passing a pivot axis of the base member 74, and dot and dash line C represents a straight line passing a tip portion of the blade 72. In this example, the straight line (B) passing the pivot axis of the base member 74 and the straight line (C) passing the tip portion of the blade 72 are inclined with respect to the base line (A) of the regulating cylindrical portion 104. This is caused by positional deviation of the supporting portion retaining hole 83 of the frame member 80 or outer dimension tolerance of the supporting rod 78, the positional deviation or tolerance of the area of insertion of the supporting rod 78 at the erected portion 74*b* of the base member 74, component tolerance of the blade member 73, and so on (refer to FIG. 7). As illustrated in FIG. 16C, if the blade member 73 and the base member 74 are fixed using screws 90 in this state, the blade pressure will be uneven in the width direction.

Figure 17C:
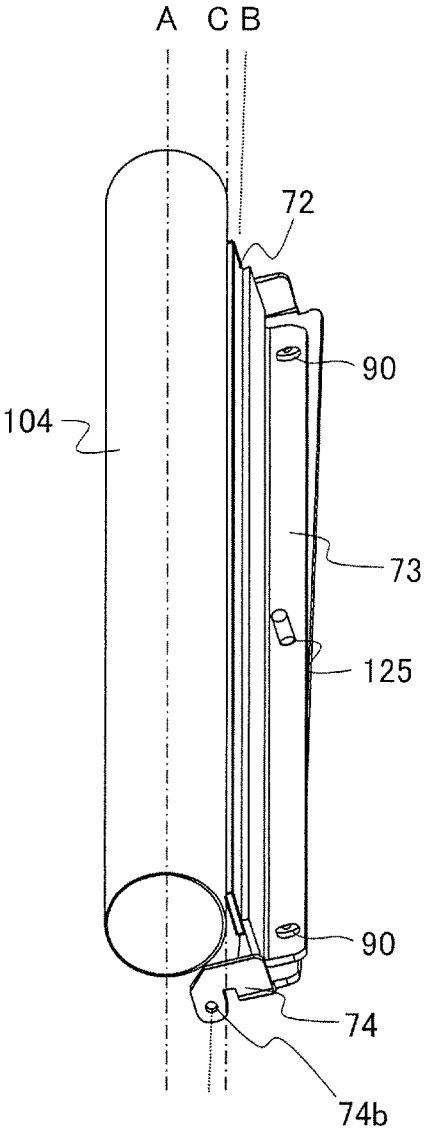
FIG. 17C is a perspective view illustrating a state where the blade member is fastened to the base member.
Figure 17B:
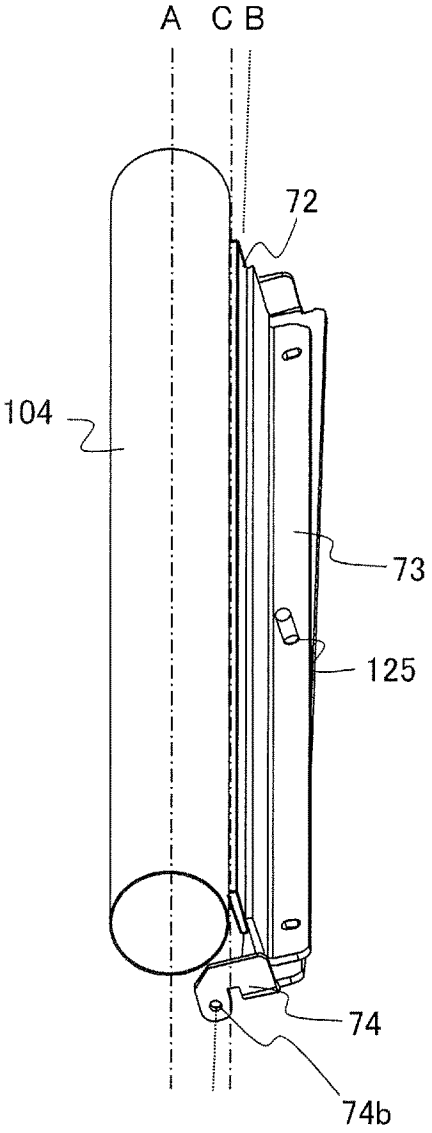
FIG. 17B is a perspective view illustrating a state where swinging of the blade is suppressed.
Figure 17A:
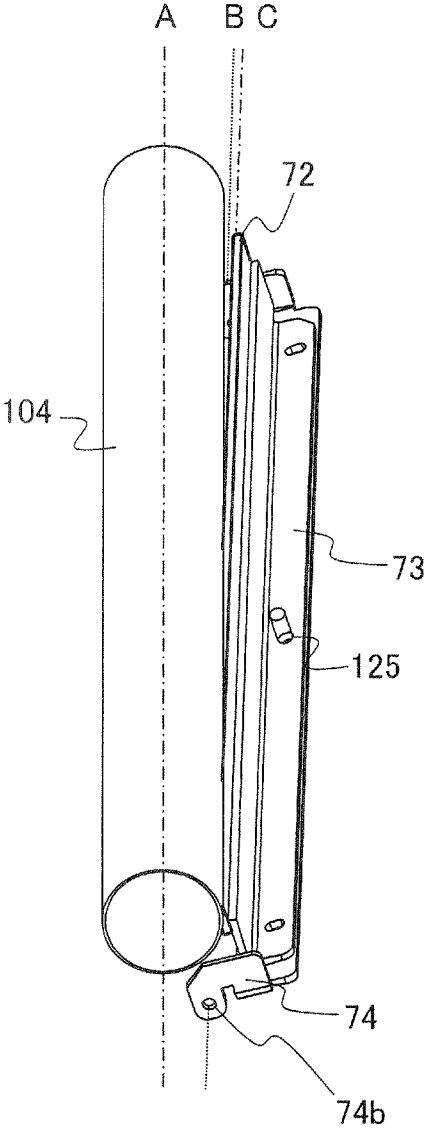
FIG. 17A is a perspective view illustrating a state immediately after the blade is started to be abutted against a cylindrical portion for regulation.

FIG. 17A illustrates a state immediately after the blade 72 has started to abut against the regulating cylindrical portion 104 (fourth step described above, refer to FIG. 11). As illustrated in FIG. 17A, at a point of time when abutting of the blade 72 has been started, abutting of the blade 72 starts from the lower side in the drawing, due to the influence of inclination of the straight line (B) passing the pivot axis of the base member 74 and the straight line (C) passing the tip portion of the blade 72 with respect to the base line (A) of the regulating cylindrical portion 104. FIG. 17B illustrates a state where the blade 72 is abutted against the regulating cylindrical portion 104 and swinging is suppressed in the fourth step described above. In a state where the user applies force to pivot the base member 74 with respect to the jig 120, the blade member 73 swings, and as illustrated in FIG. 17B, the straight line (C) passing the tip portion of the blade 72 that had been inclined with respect to the base line (A) of the regulating cylindrical portion 104 will naturally conform to the base line (A). In a state where the straight line (C) passing the tip portion of the blade 72 is approximately in parallel with the base line (A), the swinging of the blade member 73 is suppressed, and the position of the blade 72 is maintained. Then, as illustrated in FIG. 17C, in a state where the blade member 73 and the base member 74 are fixed by the screws 90, the straight line (C) that passes the tip portion of the blade 72 is maintained in a state approximately in parallel with the base line (A). In this state, the blade pressure is uniformly regulated in the width direction.

As described, according to the present embodiment, the blade member 73 and the base member 74 are installed swingably, with the first center hole 129 and the second center hole 126 serving as the center of swing. The blade member 73 and the base member 74 are fixed so as not to swing by the screws 90 in a state where the position of the blade 72 is regulated. That is, the blade member 73 having the blade 72 and the base member 74 are installed in a swingable manner, the blade member 73 is actually moved in swinging motion to regulate the position of the blade 72, and thereafter, the blade member 73 and the base member 74 are fixed by the screws 90. Thereby, stepless regulation of the blade 72 to a position achieving uniform blade pressure in the width direction corresponding to the photosensitive drum 1Y can be realized easily. Even if uneven frictional force occurs in the width direction of the photosensitive drum 1Y, chattering vibration of the blade 72 does not easily occur, and blade pressure will not be easily biased, so that a desirable cleaning effect can be achieved.

According to the embodiment described above, the pin portion 125 that swingably supports the blade member 73 and the base member 74 is provided on the jig 120, so the number of components constituting the drum cleaning device 6Y can be cut down compared to the conventional apparatus.

OTHER EMBODIMENTS

Figure 18:
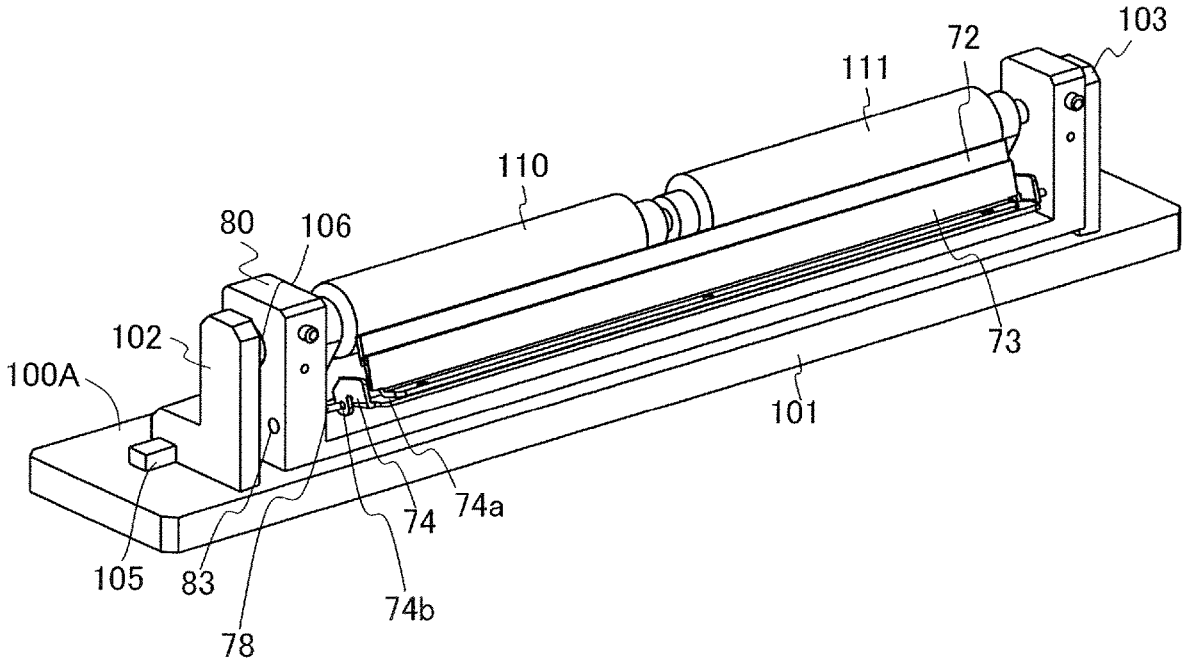
FIG. 18 is a perspective view illustrating another example of a manufacturing apparatus.

FIG. 18 illustrates another example of a manufacturing apparatus. A manufacturing apparatus 100A illustrated in FIG. 18 differs from the above-described manufacturing apparatus 100 in that a first load measuring portion 110 and a second load measuring portion 111 are provided instead of the regulating cylindrical portion 104 (refer to FIG. 5), and the other configurations are the same. In FIG. 18, the configurations similar to the manufacturing apparatus 100 described above are denoted with the same reference numbers, and descriptions thereof are omitted. In FIG. 18, the jig 120 is omitted from the drawing.

The first load measuring portion 110 and the second load measuring portion 111 are connected to a load measurement unit such as a load cell not shown, that enables blade pressure to be measured respectively when the blade 72 is abutted. In the fourth step described above, when the user applies force to the jig 120 in the direction pivoting the base member 74 and swings the blade member 73, the blade 72 is abutted against the first load measuring portion 110 and the second load measuring portion 111. In this state, the loads respectively measured by the first load measuring portion 110 and the second load measuring portion 111 are set to be approximately equal, by having both end portions of the blade member 73 pushed by a robot arm or the like not shown. In this state, the blade member 73 is fixed to the base member 74 by screws 90 (fifth step). As described, by regulating the position of the blade 72 while actually measuring the load, the blade pressure can be made uniform in the width direction more accurately. The load can be measured at two locations using the first load measuring portion 110 and the second load measuring portion 111, but the present invention is not limited thereto, and load can be measured at a plurality of locations in the width direction. In that case, it is preferable to measure the pressure at uneven number of locations, such as three or five locations, at least including one location at the center portion in the width direction and two locations on two end portions in the width direction other than the center portion in the width direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-080774, filed on Apr. 22, 2019, which is hereby incorporated by reference herein in its entirety.

What is claimed is:

1. A drum cartridge comprising:

an image bearing member configured to bear a toner image;

a frame member configured to rotatably support the image bearing member;

a blade configured to abut against the image bearing member and clean the image bearing member;

a sheet metal member configured to support the blade;

a support member configured to support the sheet metal member and provided swingably on the frame member so that the sheet metal member is swingable in a direction abutting the blade against and separating the blade from the image bearing member, the support member being urged such that the blade is urged toward a direction abutting against the image bearing member; and a fastening member configured to fix the sheet metal member to the support member, wherein one of the sheet metal member and the support member comprises a first center hole which is formed at a center portion in a longitudinal direction of the blade, and a fastening member receiving portion formed at a first end side in the longitudinal direction and configured to fasten the fastening member, and the other of the sheet metal member and the support member comprises a second center hole which is formed at the center portion in the longitudinal direction, and a through hole which is formed at the first end side in the longitudinal direction and through which the fastening member is passed, the first center hole and the second center hole being arranged such that centers thereof are overlapped, wherein the through hole is configured to be larger than the fastening member receiving portion such that the sheet metal member can be fastened to the support member by the fastening member at each of a first position and a second position which are different in a swinging direction in which the sheet metal member is swung with respect to the support member around the first and second center holes in a state where the sheet metal member and the support member are not fastened by the fastening member.

2. The drum cartridge according to claim 1, wherein the fastening member is a first fastening member and the fastening member receiving portion is a first fastening member receiving portion, the drum cartridge further comprises a second fastening member configured to fix the sheet metal member to the support member, one of the sheet metal member and the support member comprises a second fastening member receiving portion to which the second fastening member is fastened, the second fastening member receiving portion being positioned at an opposite side from the first fastening member receiving portion in the longitudinal direction, and the other of the sheet metal member and the support member comprises a through hole through which the second fastening member is passed.

3. The drum cartridge according to claim 1, wherein the through hole is a long hole formed to have a shape extending along a curved line around the first center hole and the second center hole.

4. A method for manufacturing a drum cartridge, the drum cartridge comprising an image bearing member configured to bear a toner image, a frame member configured to rotatably support the image bearing member, a blade configured to abut against the image bearing member and clean the image bearing member, a sheet metal member configured to support the blade, a support member configured to support the sheet metal member and provided on the frame member so that the sheet metal member is swingable in a direction abutting the blade against and separating the blade from the image bearing member, and a fastening member configured to fix the sheet metal member to the support member, the method comprising:

a step of installing a cylindrical portion for regulating a position of the sheet metal member with respect to the support member on the frame member;

a step of installing the support member on the frame member;

an installing step of installing the support member and the sheet metal member on a jig comprising a shaft and a clamping portion configured to clamp the support member and the sheet metal member by sliding in an axis direction of the shaft, the installing step comprising a step of passing a first center hole formed on the sheet metal member and a second center hole formed on the support member through the shaft, a step of sliding the clamping portion and clamping the support member and the sheet metal member, and a step of supporting the sheet metal member swingably with the first center hole and the second center hole serving as a center of swing;

a step of regulating a position of the sheet metal member with respect to a direction around the shaft to press the sheet metal member or the support member such that the blade is abutted against the cylindrical portion in a state where the sheet metal member is supported swingably around the shaft; and a step of fastening the support member and the sheet metal member in a state where the position of the sheet metal member is regulated with respect to the direction around the shaft.

* * * * *